United States Patent [19]

Franzen

[11] 4,120,142

[45] Oct. 17, 1978

[54] YARN INJECTION MECHANISM FOR COOPERATION WITH PNEUMATIC YARN THREADING DEVICES OF A TEXTILE YARN PROCESSING MACHINE

[75] Inventor: Gustav Franzen, Willich, Fed. Rep. of Germany

[73] Assignee: Palitex Project Company GmbH, Krefeld, Fed. Rep. of Germany

[21] Appl. No.: 842,891

[22] Filed: Oct. 17, 1977

[30] Foreign Application Priority Data

Oct. 18, 1976 [DE] Fed. Rep. of Germany ..... 2646921

[51] Int. Cl.[2] ..... D01H 15/00; D01H 13/04

[52] U.S. Cl. ..... 57/34 R; 57/58.7; 57/106; 57/58.83

[58] Field of Search ..... 57/34 R, 34 B, 34.5, 57/58.49, 58.7, 58.83, 106

[56] References Cited

U.S. PATENT DOCUMENTS

| | | | |
|---|---|---|---|
| 3,424,359 | 1/1969 | Houle et al. | 57/34 B X |
| 3,731,478 | 5/1973 | Franzen | 57/34 R X |
| 3,834,144 | 9/1974 | Franzen | 57/58.7 X |
| 3,924,392 | 12/1975 | Franzen et al. | 57/58.7 X |
| 3,939,633 | 2/1976 | Lossa | 57/58.7 X |
| 3,942,312 | 3/1976 | Venot | 57/106 X |
| 3,975,893 | 8/1976 | Franzen | 57/34 R |
| 3,981,128 | 9/1976 | Munker | 57/58.7 X |
| 4,026,095 | 5/1977 | Kobatake et al. | 57/34 R X |

*Primary Examiner*—Donald Watkins

*Attorney, Agent, or Firm*—Bell, Seltzer, Park & Gibson

[57] ABSTRACT

A pneumatic yarn injection mechanism is provided for being operatively associated with textile machines and particularly pneumatic threading mechanisms of spindle assemblies of textile yarn processing machines, such as two-for-one twisters. The pneumatic yarn injection mechanism is characterized by a construction for creating a suction therein for grasping a free end of yarn extending outwardly from a supply package of yarn in the spindle assembly of the textile machine and for creating a positive air stream therein for conveying the free end of yarn therefrom to a desired location in the spindle assembly of the textile machine for receipt by a suction air stream created by the pneumatic threading mechanisms for effecting threading-up of the spindle assembly and to eliminate manual handling of the free end of yarn during such pneumatic threading-up of the spindle assembly.

11 Claims, 4 Drawing Figures

YARN INJECTION MECHANISM FOR COOPERATION WITH PNEUMATIC YARN THREADING DEVICES OF A TEXTILE YARN PROCESSING MACHINE

This invention relates to a pneumatic yarn injection mechanism and related devices for use with textile machines processing yarn, such as during a threading-up operation of the machine, characterized by a construction for grasping a free end of yarn extending outwardly from the textile machine and for conveying the free end of yarn to a desired location in the textile machine.

BACKGROUND OF THE INVENTION

In textile machines which process yarn, it is often necessary to grasp a free end of the yarn and to convey this free end of yarn to another desired location in the textile machine. This is particularly true in the case of a two-for-one twister textile yarn processing machine utilizing pneumatic threading mechanisms for threading-up the spindle assemblies thereof upon starting-up of the spindle assembly or following breakage of the yarn during processing. Such for two-for-one twister textile yarn processing machines with pneumatic threading mechanisms for threading-up the spindle assembly are disclosed in U.S. Pat. 3,731,478, issued May 8, 1973, and U.S. Pat. No. 3,975,893, issued Aug. 24, 1976, both of which are assigned to the assignee of the present invention.

As may be seen in both of these U.S. patents, there is provided a two-for-one twister or the like textile yarn processing machine having a plurality of spindle assemblies mounted in generally side-by-side relationship along the outside of the machine and each including a driven rotating rotor mechanism, a stationary carrier mechanism for carrying a hollow supply package of yarn, and an elongate yarn passageway extending downwardly through the top of the carrier mechanism along the axis of the spindle assembly and radially outwardly through the rotor mechanism for receiving the yarn from the supply package therethrough and then upwardly along the outside of the carrier mechanism for forming a rotating balloon of yarn during yarn processing and which is subsequently taken-up by a take-up mechanism. There is also described in these U.S. patents selectively-operable pneumatic threading mechanisms for automatically threading yarn withdrawn from the supply package through the yarn passageway of the spindle assembly by creating a suction through the yarn entry portion of the passageway and a positive air stream through the yarn exit portion of the passageway.

In order to accomplish suitable pneumatic threading-up with the pneumatic threading mechanisms disclosed in the above U.S. patents, the free end of yarn must be pulled from the supply package of yarn and positioned at the entry of the yarn passageway through the spindle assembly so that the suction may pull the yarn into the yarn passageway and be conveyed through and out of the yarn passageway by the suction and positive air stream created therein.

Accordingly, in the event of a yarn breakage or the start-up of a yarn processing operation, the above manual positioning of the free end of yarn must be performed by an operator at each spindle assembly which utilizes as substantial amount of operator time. No mechanisms have heretofore been proposed for cooperating with pneumatic threading mechanisms of spindle assemblies of textile yarn processing machines for properly positioning a free end of yarn at a desired location in the textile machine for effecting the pneumatic threading-up of the spindle assembly.

OBJECTS AND SUMMARY OF THE INVENTION

Accordingly, it is the object of this invention to overcome the above-described problems and to provide a mechanism for use with textile machines processing yarn, such as during threading-up operations of the machine, which will grasp a free end of yarn extending outwardly from the textile machine and convey the free end of yarn to the desired location in the textile machine.

It has been found by this invention that the above object may be accomplished by providing a pneumatic yarn injection means for use with textile machines processing yarn, such as during a threading-up operation of the machine, which is characterized by a construction for grasping a free end of yarn extending outwardly from the textile machine and for conveying the free end of yarn to a desired location in the textile machine, and particularly for use with a textile yarn processing machine, such as a two-for-one twister or the like, including the following mechanisms.

A plurality of spindle assemblies are mounted in generally side-by-side relationship along the outside of the machine and each including a driven rotating rotor mechanism, a stationary carrier mechanism for carrying a hollow supply package of yarn, and an elongate yarn passageway extending downwardly through the top of the carrier mechanism along the axis of the spindle assembly and radially outwardly through the rotor mechanism for receiving the yarn from the supply package therethrough during processing. The yarn processing machine also includes selectively-operable pneumatic threading mechanisms for being operated to automatically thread yarn withdrawn from the supply package through the yarn passageway during threading-up of the spindle assemblies by creating a suction through the yarn entry portion of the passageway and a positive air stream through the yarn exit portion of the passageway.

The pneumatic yarn injector mechanism of this invention grasps the free end of yarn extending outwardly from the supply package of yarn along the outside of the machine and creates a positive air stream therein for conveying the grasped free end of yarn therefrom to the entry portion of the yarn passageway through the spindle assembly for receipt by the suction created therethrough by a pneumatic threading mechanism for effecting threading-up of the spindle assembly and for eliminating manual handling of the free end of the yarn during such pneumatic threading-up of the spindle assembly.

The pneumatic yarn injection means preferably comprises an elongate duct having an air passageway therethrough and a slot extending from the outside thereof to the air passageway along the length thereof and positioned on the side thereof facing the spindle assembly, and air injection nozzle means communicating with an intermediate portion of the air passageway through the duct means for creating the positive air stream out of one end of the duct means and the suction through the other end of the duct means.

There is further preferably provided a yarn gripper means mounted on the front of each of the spindle assemblies at the outside of the machine for releasably receiving and holding the free end of yarn extending outwardly from the supply package of yarn carried by the spindle assembly in a convenient position for grasping thereof by the pneumatic injection means and for releasing the free end of yarn during conveying thereof by the pneumatic means to the entry portion of the yarn passageway through the spindle assembly.

There is also preferably provided a trolley mechanism mounted for movement along the outside of the textile yarn processing machine and along the front of each of the spindle assemblies for carrying the pneumatic injection means so that the pneumatic injection means may be conveniently positioned in front of a respective spindle assembly when a threading-up operation is desired.

BRIEF DESCRIPTION OF THE DRAWINGS

Some of the objects and advantages along with a broad description of this invention have been set forth above; however, other objects, advantages and a more detailed description of the invention will appear as the description proceeds, when taken in conjunction with the following drawings, in which.

DESCRIPTION OF PREFERRED EMBODIMENT

While the drawings and specific description to follow will be related to a two-for-one twister textile yarn processing machine, having penumatic spindle assembly threading mechanisms in accordance with assignee's above-mentioned U.S. Pat. No. 3,975,893, which is the preferred textile machine and the preferred spindle assembly pneumatic threading mechanisms for use with the pneumatic yarn injection mechanism of this invention, it is to be understood that this pneumatic yarn injection mechanism and related devices of this invention could be utilized with other textile machines and with two-for-one twister yarn processing machines having other types of automatic threading mechanisms.

Figure 1:
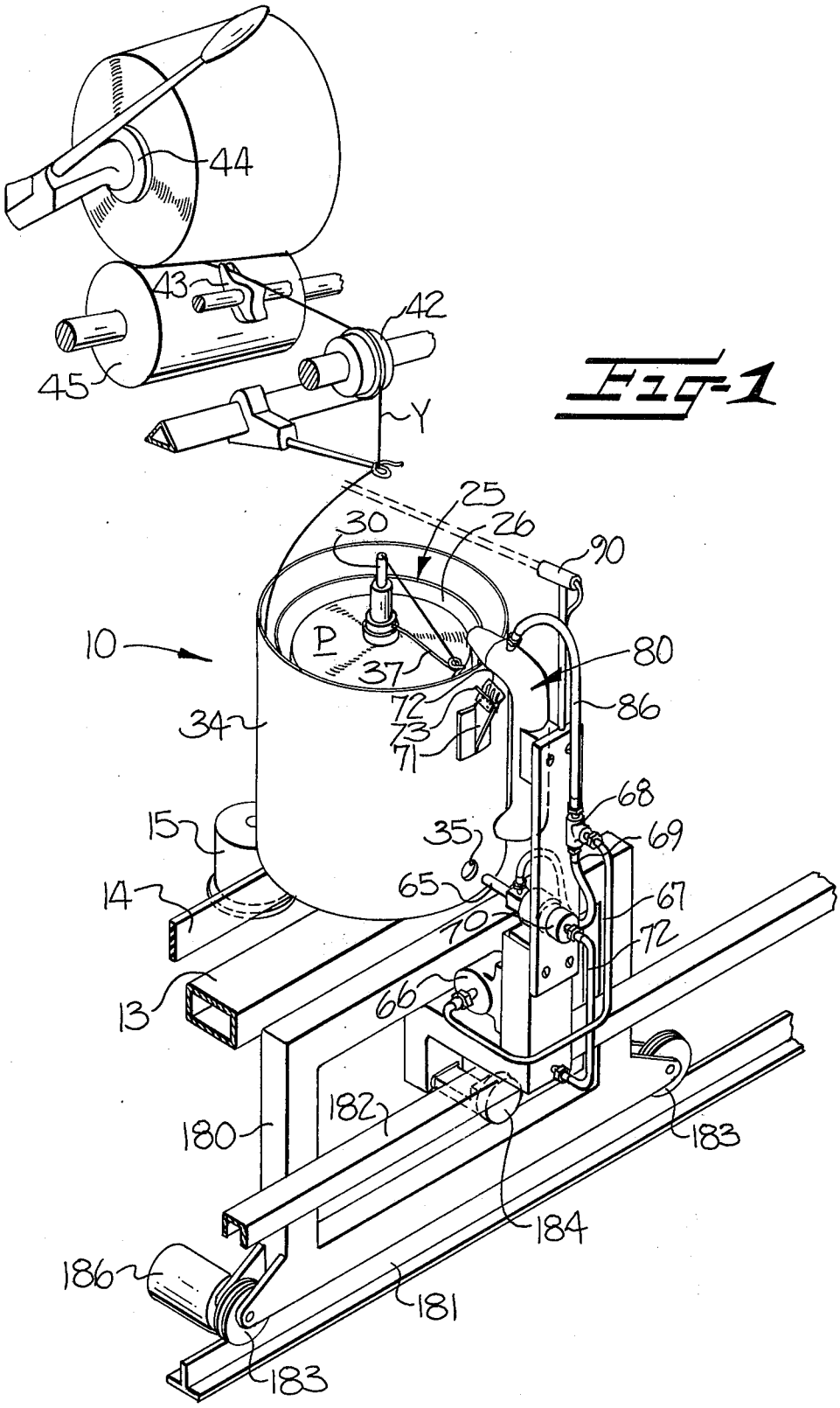
FIG. 1 is a somewhat schematic, perspective view of one spindle assembly station of a two-for-one twister textile yarn processing machine utilizing the improved yarn injector mechanism and related devices of this invention.

Referring now to the drawings, there is illustrated in FIG. 1, a schematic perspective view of a single spindle assembly station, generally indicated at 10, of a two-for-one twister textile yarn processing machine. It is to be understood that a plurality of these spindle assembly stations 10 are provided in a two-for-one twister in side-by-side relationship in two rows along the outsides of the machine. A full illustration and description of the entire two-for-one twister is not given herein and is not believed to be necessary for an understanding of the present invention, the operation and complete structure of such two-for-one twisters are well understood by those with ordinary skill in the art.

Each of the spindle assemblies 10 comprise a rotatably driven rotor mechanism, generally indicated at 11, which includes a whorl portion 12 suitably rotatably mounted on a portion of the twister frame 13 and rotated by a continuous tangential drive belt 14 in a manner well understood by those with ordinary skill in the art. Tension rolls 15 are associated with each spindle assembly station 10 and are pivotally mounted for engaging and holding the drive belt 14 in tight driving engagement with the whorl portion 12 for normal rotation of the rotor mechanism 11 of the spindle assembly 10. The rotor mechanism 11 further includes a horizontally-extending yarn reserve disc device 16 secured to the whorl 12 for rotation therewith and a generally vertically-extending hollow axle device 17 which also rotates with the yarn reserve disc 16. The yarn reserve disc 16 and hollow axle device 17 define therewithin a generally L-shaped yarn passageway 20 extending generally vertically downwardly through the hollow axle device 17 and a portion of the yarn reserve disc 16 and generally horizontally and radially out of the yarn reserve disc 16 (see FIG. 2).

The spindle assembly station 10 further includes a stationary carrier mechanism, generally indicated at 25, for supporting and carrying a hollow package P of yarn Y and which is rotatably mounted on the rotor mechanism 11 so that the rotor mechanism 11 may rotate relative thereto. The carrier mechanism 25 comprises a basket device 26 which surrounds the package P of yarn Y, a circular bottom portion 27 for supporting the hollow yarn supply package P and a hollow hub portion 28 extending into the hollow yarn supply package P for stabilizing the yarn supply package. The hollow hub portion 28 may include a hollow yarn package carrier member 29 in partial telescoping relationship therewith which carries a hollow yarn entry tube 30 at the upper end thereof. As may be seen in FIG. 2, the hollow axle device 17 of the rotor mechanism 11 extends into the hollow hub portion 28 of the carrier mechanism 25 and the carrier mechanism 25 is rotatably mounted on the rotor mechanism 11 by means of bearings 32, so that the rotor mechanism 11 may rotate relative to the stationary carrier mechanism 25 which is held stationary by any suitable means, such as magnet devices 33.

Carrier mechanism 25 including the carrier member 29, the yarn entry tube 30 and the hollow interior of the hub portion 28 define a generally vertically-extending yarn passageway 31 which is disposed in axial alignment with the yarn passageway 20 through the rotor mechanism 11 and joins with the yarn passageway 20 for providing a continuous elongate yarn passageway 31, 20 passing downwardly through the top of the carrier mechanism 25, along the axis of the spindle assembly 10 and radially outwardly through the rotor mechanism 11. Spindle assembly station 10 further includes a stationary balloon limitor device 34 surrounding the basket device 26 of the carrier mechanism 25 and having an aperture 35 therein for purposes to be described below. There is further included a pigtail flyer mechanism 37 rotatably mounted on the carrier member 29 and a yarn guide eyelet 40 positioned above and in axial alignment with a yarn entry tube 30 and the yarn passageway 31 therethrough. There is also included a pre-take-up roll 42, a yarn traversing mechanism 43 and a yarn take-up or package roll device 44 upon which the yarn Y is wound after being processed by the spindle assembly station 10. The package roll device 44 is rotated by friction drive roll 45 in a well known manner.

With the above-described mechanisms, the yarn Y is withdrawn from the package P, passes through the pigtail flyer mechanism 37, through the yarn entry tube 30 and the yarn passageway 31. From the passageway 31, the yarn Y passes through the generally L-shaped yarn passageway 20 of the rotating rotor mechanism 11 and out of the reserve disc 16. The yarn then passes upwardly between the basket device 26 and the balloon limitor 34 to form a rotating balloon of yarn Y as the rotor mechanism 11 is rotated. The yarn Y then passes through yarn guide eyelet 40 which limits the upper end of the rotating balloon of yarn, over pre-take-up roll 42 and is traversed by traversing mechanism 43 onto the package roll device 44 to complete its travel through the respective spindle assembly station 10. As is well understood by those with ordinary skill in the art, a two-for-one twist is inserted in the yarn during the above-noted path of travel.

The spindle assembly station 10 further includes pneumatically-operated, yarn threading mechanisms for automatically threading the yarn Y withdrawn from the supply package P through the yarn passageway 31, 20 during threading-up of the spindle assembly station 10. These automatic, pneumatic, threading mechanisms may be constructed generally in accordance with the above-mentioned U.S. Pat. Nos. 3,975,873 or 3,731,478 of the assignee of the present invention; however, the pneumatic threading-up mechanisms of assignee's U.S. Pat. No. 3,975,873 are preferred and have been broadly illustrated and described herein.

As may be seen in the drawings, these pneumatic threading-up mechanisms include a selectively-operated, air injector nozzle, generally indicated at 50, which selectively receives air under pressure from a connector 65 leading from a suitable source of compressed air 66 via conduit 67, valve 68 and conduit 69. The connector 65 is movably mounted by piston and cylinder mechanism 70, 71 for being moved into and out of engagement through aperture 35 in balloon limitor 34 with an aperture 73 in the bottom portion 27 of the carrier mechanism 25. The aperture 73 leads by way of an air passageway 74 through the carrier mechanism 25 to the injector nozzle 50 for creating a positive air stream through the yarn passageway 20 through the rotor mechanism 11 and creates a negative air flow or suction through the yarn passageway 31 of the carrier mechanism 25.

The connector mechanism 65 is moved into and out of engagement with the aperture 73 and the air passageway 70 by the piston and cylinder mechanism 70, 71 which receives compressed air from a conduit 72 extending from any suitable source of compressed air and is returned by a spring means contained within the cylinder 71. By the above arrangement, when the connector 65 is selectively inserted into the aperture 73 in the stationary carrier mechanism 25 by movement through the aperture 35 in the balloon limitor 34, the above-described air streams will be created so that yarn Y pulled from the supply package P may be placed at the entry to the yarn passageway 31 through the yarn entry tube 30 and will be sucked into the yarn passageway 31 to be pneumatically threaded therethrough and out of the yarn passageway 20 for automatic threading-up of the spindle assembly 10 during start-up or in the event of yarn breakage during yarn processing.

Figure 4:
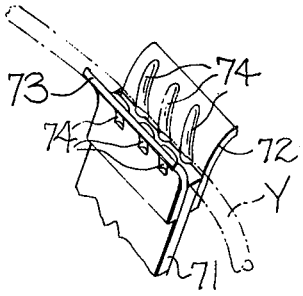
FIG. 4 is an enlarged, perspective detail, partly broken away, of the yarn gripper device illustrated in FIGS. 1 and 2.
Figure 3:
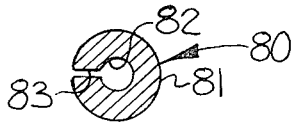
FIG. 3 is a cross-sectional view taken through a portion of the yarn injection mechanism and along the line 3—3 of FIG. 2.

In accordance with this invention, there is provided a yarn gripper means 70 mounted on the front of each of the spindle assemblies at the outside of the machine for releasably receiving and holding the free end of yarn Y extending outwardly from the yarn supply package P carried by the spindle assembly 10. Preferably, the yarn gripper means comprises plates 71, 72, 73 secured together in a generally Y-shaped configuration having the lower end 71 secured to the spindle assembly, such as to the balloon limitor 34 as illustrated in the drawings or to an additional outside frame portion if utilized, and outwardly flared upper ends 72, 73. The outwardly flared upper ends 72, 73 have grooves 74 on the inside surfaces thereof inclined from the top to the bottom away from the spindle assembly 10 for the receiving and holding a free end of yarn Y therebetween (see FIGS. 2 and 4) resisting downward movement of the yarn Y therethrough while allowing easy release of the yarn Y in an upward direction, for purposes to be described below.

In accordance with this invention, there is also provided a pneumatic yarn injector means, generally indicated at 80, preferably in the form of an elongate duct 81 having an air passageway 82 therethrough and a slot 83 extending from the outside thereof to the air passageway 82 along the length thereof and positioned on the side thereof facing the spindle assembly 10. The elongate duct 81 is provided with an air injection nozzle 85 receiving a flow of compressed air from a conduit 86 leading from the valve 68, conduit 67, and compressed air source 66. The air injector nozzle 85 communicates with an intermediate portion of the air passageway 82 through the duct 81 for creating a suction through a lower end 81' and preferably through an intermediate portion 81' for grasping the free end of yarn Y extending outwardly from the supply package P of yarn Y along the outside of the machine, which is preferably being held by the gripper means 70, and for creating a positive air stream through the other upper end 81''' of the duct means for conveying the grasped free end of yarn therefrom to the entry portion of the yarn passageway 31 through the spindle assembly 10 for receipt by the suction created therethrough by the pneumatic threading mechanisms, while allowing the intermediate portion of the yarn Y between the free end thereof and the supply package to pass through the slot 83 in the duct 81 for complete removal of the yarn Y from the duct 81 and to effect threading-up of the spindle assembly and to eliminate manual handling of the free end of yarn Y during such pneumatic threading-up of the spindle assembly 10. As the free end of yarn Y is conveyed upwardly through duct 81 and out of the upper end 81''' toward the entry portion of the yarn passageway 31 in the spindle assembly 10, the yarn Y will be moved upwardly in the gripper 70 and due to the orientation of the groove 74 therein, is easily released therefrom.

The duct 81 preferably comprises a generally vertically-extending intermediate portion 81'', a curved lower end 81' pointing toward an intermediate portion of the spindle assembly 10 in which the free end of yarn extending from the supply package would be positioned, such as in the gripper 70, and a curved upper end 81''' pointing toward the entry portion of the yarn passageway 31 through the spindle assembly 10.

Figure 2:
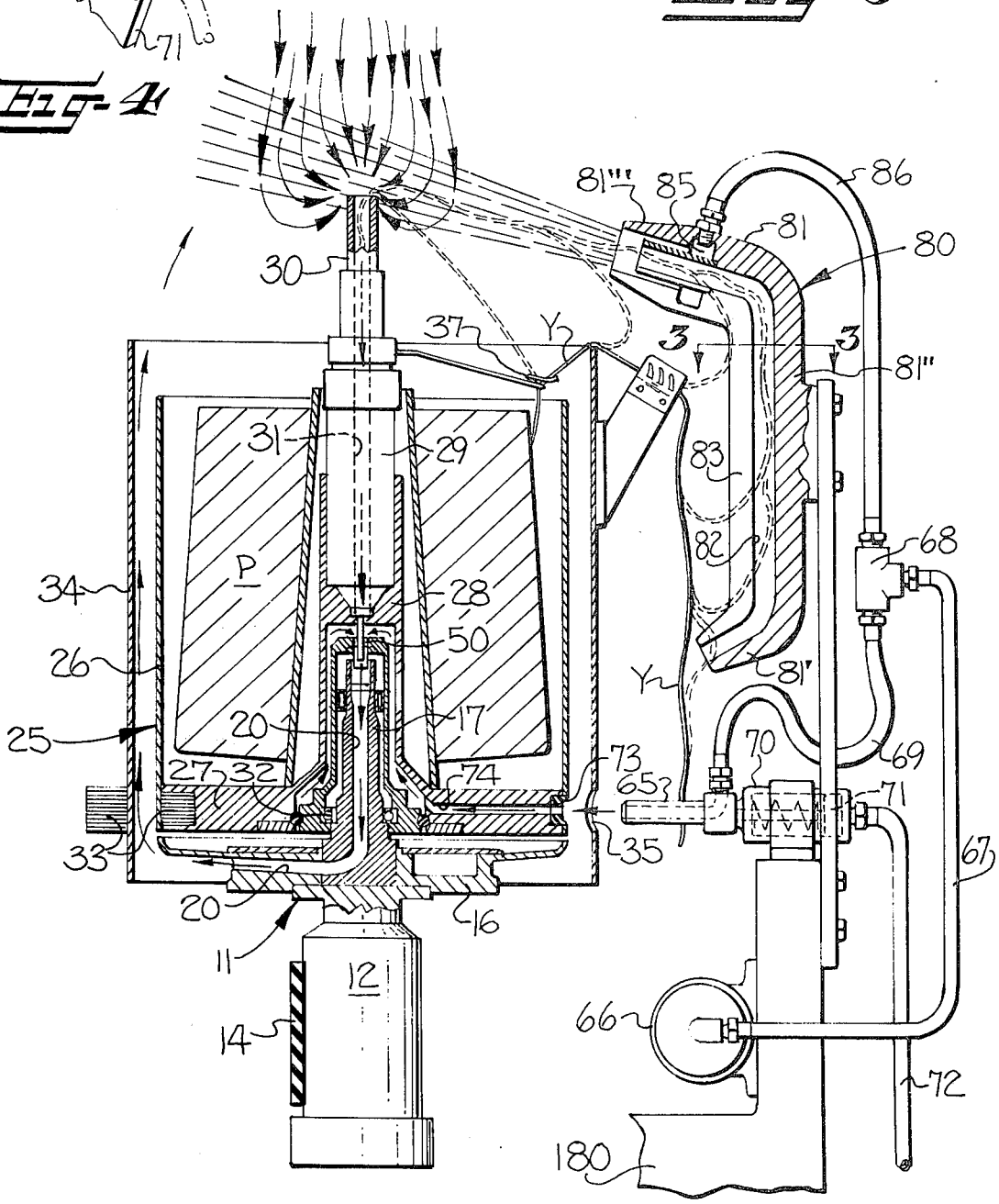
FIG. 2 is an enlarged, partial, elevational, cross-sectional view taken through a portion of the apparatus illustrated in FIG. 1.

When the pneumatic yarn injector means 80 of this invention is utilized with the two-for-one twister textile yarn processing machine, illustrated in the drawings herein, it is preferable to provide a trolley mechanism 180 which is suitably mounted on rails 181, 182 by wheels or rollers 183, 184 for movement along each side of the yarn processing machine and along each of the spindle assembly stations 10. The trolley mechanism 180 suitably mounts the pneumatic yarn injector means 180, as shown in FIGS. 1 and 2, for movement therewith so that the pneumatic yarn injector means 80 may be conveniently positioned in front of a respective spindle assembly 10 when a threading-up operation thereof is desired.

As illustrated in the drawings herein, it is also convenient to position the connector 65 of the spindle assembly threading mechanisms on the trolley mechanism 180 for desired positioning at a specific spindle assembly location when a threading-up operation is desired. The trolley mechanism 180 may be driven by a drive motor 186 for automatic positioning.

When both the pneumatic yarn injector means 80 and the connector 65 of the pneumatic threading mechanisms are carried by the trolley mechanism 180, the sources of compressed air to the injection nozzles 50, 85 may lead from a suitable common source 66 and may include a valve 68 for simultaneously turning-on and shutting-off the flow of compressed air through the respective conduit 69, 86 to the respective injector nozzles 50, 85.

The mechanisms of this invention may include a suitable control circuit or other type of control mechanisms (not shown) for positioning the trolley mechanism and effecting automatic operation of the above-described pneumatic yarn injector means and spindle assembly threading mechanisms; however, such control mechanism does not form a specific part of this invention and will not be described herein. Additionally, a yarn scanning mechanism, such as the optical scanner 90 illustrated in FIG. 1, may be provided for sensing the yarn Y after it has been threaded through the spindle assembly 10 for shutting-off the supply of compressed air to the pneumatic yarn injector 80 and to the spindle assembly pneumatic threading mechanism by operating the valve 68.

In operation, when a processed package of yarn has been doffed from a particular spindle assembly 10 of the two-for-one twister textile yarn processing machine and a new supply package P of yarn to be processed has been placed in the spindle assembly 10 or when yarn Y has broken during the processing thereof, the spindle assembly 10 is shut off and an operator will grasp the free end of yarn Y extending from the supply package P and pull it up a sufficient length for threading through the spindle assembly 10 and place it in the yarn gripper 70 on the outside of the spindle assembly 10. The trolley mechanism 180 will then, either manually or automatically, be moved into position in front of the spindle assembly 10.

The compressed air streams to the pneumatic yarn injector 80 and to the connector 65 of the pneumatic threading mechanisms of the spindle assembly will be simultaneously activated causing the creation of a suction through the yarn entry portion and a positive air flow through the yarn exit portion of the yarn passageway 20, 31 of the spindle assembly 10, and of a suction through the lower end 81' and a positive air flow out of the upper end 81''' of the duct 81 through the passageway 82. This will cause the free end of yarn Y hanging down from the gripper 70 to be sucked into the lower end 81' of the duct 81, to be conveyed along the intermediate portion 81'' and out of the upper end 81''' of the duct 81 for being conveyed toward the yarn entry portion of the passageway 31, 20 through the spindle assembly 10. The intermediate portion of the yarn Y extending between the free end and the supply package P will pass through the slot 83 in the duct 81 to be completely removed from the yarn injector 80. Also, the yarn will be lifted out of and released from the gripper 70. The yarn will be threaded through the spindle assembly 10 and upon completion of such threading operation, the optical yarn sensor 90 will sense the presence of yarn Y through the spindle assembly 10 and deactivate the flow of compressed air through the pneumatic yarn injector 80 and the connector 65 of the pneumatic yarn threading mechanisms to complete a cycle of operation of the mechanisms of this invention.

In the drawings and specification, there has been set forth a preferred embodiment of the invention and, although specific terms are employed, they are used in a generic and descriptive sense only and not for purposes of limitation.

What is claimed is:

1. In a textile yarn processing machine, such as a two-for-one twister or the like, the combination of:

a plurality of spindle assemblies mounted in generally side-by-side relationship along the outside of said machine and each including a driven rotating rotor mechanism, a stationary carrier mechanism for carrying a hollow supply package of yarn, and an elongate yarn passageway extending downwardly through the top of said carrier mechanism along the axis of said spindle assembly and radially outwardly through said rotor mechanism for receiving the yarn from the supply package therethrough during yarn processing;

selectively-operable pneumatic threading mechanisms for being operated to automatically thread yarn withdrawn from the supply package through said yarn passageway during threading-up of said spindle assemblies by creating a suction through the yarn entry portion of said passageway and a positive air stream through the yarn exit portion of said passageway; and pneumatic yarn injection means, operatively associated with said threading mechanisms of each of said spindle assemblies, for creating a suction extending therein for grasping and containing therein a free end of yarn extending outwardly from the supply package of yarn along the outside of said machine and for creating a positive air stream extending thereout for conveying and comletely releasing the grasped and contained free end of yarn therefrom to the entry portion of said yarn passageway through said spindle assembly for receipt by the suction created therethrough by said pneumatic threading mechanisms for effecting threading-up of said spindle assembly and to eliminate manual handling of the free end of yarn during such pneumatic threading-up of said spindle assembly.

2. In a textile yarn processing machine, as set forth in claim 1, further including a trolley mechanism mounted for movement along the outside of said textile yarn processing machine and along the front of each of said spindle assemblies and carrying said pneumatic injection means so that said pneumatic injection means may be conveniently positioned in front of a respective spindle assembly when a threading-up operation thereof is desired.

3. In a textile yarn processing machine, as set forth in claim 1, further including a yarn gripper means mounted on the front of each of said spindle assemblies at the outside of said machine for releasably receiving and holding the free end of yarn extending outwardly from the supply package of yarn carried by said spindle assembly in a convenient position for grasping thereof by said pneumatic injection means and for releasing the free end of yarn during conveying thereof by said pneumatic injection means to the entry portion of said yarn passageway through said spindle assembly.

4. In a textile yarn processing machine, as set forth in claim 3, in which said yarn gripper comprises plate means of a generally Y-shaped configuration having a lower end secured to said spindle assembly and outwardly flared upper ends having grooves therein inclined from the top to the bottom away from said spindle assembly for receiving and holding a free end of yarn therebetween resisting downward movement of the yarn therethrough while allowing easy release of the yarn in the upward direction during conveying of the free end of yarn by said pneumatic injection means.

5. In a textile yarn processing machine, as set forth in claim 1, in which said pneumatic yarn injection means comprises an elongate duct means having an air passageway therethrough and a slot extending from the outside thereof to said air passageway along the length thereof and positioned on the side thereof facing said spindle assembly, and air injection nozzle means communicating with an intermediate portion of said air passageway through said duct means for creating a positive air stream out of one end of said duct means and a suction through the other end of said duct means, so that the free end of yarn may be grasped at the other end of said duct means and conveyed through said air passageway and out of the one end of said duct means and so that the intermediate portion of the yarn between the free end thereof and the supply package may pass through said slot for complete removal of the yarn from said duct means.

6. In a textile yarn processing machine, as set forth in claim 5, in which said duct means comprises a generally vertically-extending intermediate portion, a curved lower end pointing toward an intermediate portion of said spindle assembly in which the free end of yarn extending from the supply package would be positioned, and a curved upper end thereof pointing toward the entry portion of said yarn passageway through said spindle assembly.

7. In a textile yarn processing machine, as set forth in claim 1, in which said selectively-operable pneumatic threading mechanisms comprise an injection nozzle means communicating with an intermediate portion of said elongate yarn passageway extending through said spindle assembly for injecting a positive air stream therein in the direction of flow of yarn therethrough for creating the suction through the yarn entry portion of said passageway and the positive air stream through the yarn exit portion of said passageway, an air flow passageway extending through said stationary carrier mechanism of said spindle assembly and communicating at one end thereof with said injection nozzle means and having at the other end thereof aperture means at the front of said spindle assembly along the outside of said machine for receiving and conveying a positive air flow therethrough to said injection nozzle means, and connector means including a source of compressed air and mounted for movement into and out of said aperture means for supplying a positive air flow into said air passageway and through said injection nozzle means.

8. In a textile yarn processing machine, such as a two-for-one twister or the like, the combination of:

a plurality of spindle assemblies mounted in generally side-by-side relationship along the outside of said machine and each including a driven rotating rotor mechanism, a stationary carrier mechanism for carrying a hollow supply package of yarn, and an elongate yarn passageway extending downwardly through the top of said carrier mechanism along the axis of said spindle assembly and radially outwardly through said rotor mechanism for receiving the yarn from the supply package therethrough during yarn processing;

selectively-operable pneumatic threading mechanisms for being operated to automatically thread yarn withdrawn from the supply package through said yarn passageway during threading-up of each of said spindle assemblies comprising an air injection nozzle means communicating with an intermediate portion of said yarn passageway for injecting a positive air stream therein in the direction of flow of yarn therethrough for creating a suction through a yarn entry portion of said yarn passageway and a positive air stream through a yarn exit portion of said yarn passageway, an air flow passageway extending through said stationary carrier mechanism and communicating at one end thereof with said injection nozzle means and having at the other end thereof aperture means at the front of said spindle assembly along the outside of said machine for receiving and conveying a positive air flow therethrough to said injection nozzle means, and connector means including a source of compressed air and mounted for movement into and out of said aperture means for supplying a positive air flow into said air passageway and through said injection nozzle means; and pneumatic yarn injection means comprising an elongate duct means having an air passageway therethrough and a slot extending from the outside thereof to said air passageway along the length thereof and positioned on the side thereof facing said spindle assembly, air injection nozzle means including a source of compressed air communicating with an intermediate portion of said air passageway through said duct means for creating a suction through one end of said duct means for grasping a free end of yarn extending outwardly from the supply package of yarn along the outside of said machine and for creating a positive air stream through the other end of said duct means for conveying the grasped free end of yarn therefrom to the entry portion of said yarn passageway through said spindle assembly for receipt by the suction created therethrough by said pneumatic threading mechanisms while allowing the intermediate portion of the yarn between the free end thereof and the supply package to pass through said slot in said duct means for complete removal of the yarn from said duct means and to effect threading-up of said spindle assembly and to eliminate manual handling of the free end of yarn during such pneumatic threading-up of said spindle assembly; and a trolley mechanism mounted for movement along the outside of said textile yarn processing machine and along the front of each of said spindle assemblies and carrying said pneumatic injection means and said connector means of said threading mechanisms for convenient positioning thereof in front of a respective spindle assembly when a threading-up operation is desired.

9. In a textile yarn processing machine, as set forth in claim 8, in which said sources of compressed air providing a positive air flow to said injection nozzle of said connector means of said pneumatic threading mechanisms and said injection nozzle of said injection means include means connecting said sources of compressed air for simultaneous actuation and deactuation of said pneumatic threading mechanisms and said pneumatic injection means.

10. In a textile yarn processing machine, as set forth in claim 9, further including yarn scanning means for sensing the presence of yarn after threading-up of said spindle assembly for deactuating said sources of compressed air and thus deactuating both said pneumatic threading mechanisms and said pneumatic injection means.

11. In a textile yarn processing machine, such as a two-for-one twister or the like, the combination of:

a plurality of spindle assemblies mounted in a generally side-by-side relationship along the outside of said machine and each including a driven rotating rotor mechanism, a stationary carrier mechanism for carrying a hollow supply package of yarn, and an elongate yarn passageway extending downwardly through the top of said carrier mechanism along the axis of said spindle assembly and radially outwardly through said rotor mechanism for receiving the yarn from the supply package therethrough during yarn processing;

selectively-operable pneumatic threading mechanisms for being operated to automatically thread yarn withdrawn from the supply package through said passageway during threading-up of each of said spindle assemblies comprising an air injection nozzle means communicating with an intermediate portion of said yarn passageway for injecting a positive air stream therein in the direction of flow of yarn therethrough for creating a suction through the yarn entry portion of said yarn passageway and a positive air stream through a yarn exit portion of said yarn passageway, an air flow passageway extending through said stationary carrier mechanism communicating at one end thereof with said injection nozzle means and having at the other end thereof aperture means at the front of said spindle assembly along the outside of said machine for receiving and conveying a positive air flow therethrough to said injection nozzle means, and connector means including a source of compressed air and mounted for movement into and out of said aperture means for supplying a positive air flow into said air passageway and through said injection nozzle means;

a yarn gripper means mounted on the front of each of said spindle assemblies at the outside of said machine for releasably receiving and holding a free end of yarn extending outwardly from the supply package of yarn while allowing easy release of the yarn when threading thereof through said spindle assembly by said pneumatic threading means is desired; and pneumatic yarn injection means comprising an elongate duct means having an air passageway therethrough and a slot extending from the outside thereof to said air passageway along the length thereof on the side thereof facing said spindle assembly and comprising a generally vertically-extending intermediate portion and a curved lower end pointing toward an intermediate portion of said spindle assemby in which the free end of yarn extending from said yarn gripper means is positioned and a curved upper end thereof pointing toward the entry portion of said yarn passageway through said spindle assembly, air injection nozzle means communicating with an intermediate portion of said air passageway through said duct means for creating a suction through said curved lower end of said duct means for grasping the free end of the yarn extending from said gripper means and for creating a positive air stream through said curved upper end of said duct means for conveying the grasped free end of yarn therefrom and out of said yarn gripper means to the entry portion of said yarn passageway through said spindle assembly for receipt by the suction created therethrough by said pneumatic threading mechanisms while allowing the intermediate portion of the yarn between the free end thereof and the supply package to pass through said slot in said duct means for complete removal of the yarn from said duct means and to effect threading-up of said spingle assembly and to eliminate manual handling of the free end of yarn during such pneumatic threading-up of said spindle assembly; and a trolley mechanism mounted for movement along the outside of said textile yarn processing machine and along the front of each of said spindle assemblies and carrying said pneumatic injection means and said connector means of said threading mechanisms for conveniently positioning thereof in front of a respective spindle assembly when a threading-up operation thereof is desired.

* * * * *

UNITED STATES PATENT AND TRADEMARK OFFICE

CERTIFICATE OF CORRECTION

PATENT NO. : 4,120,142

DATED : October 17, 1978

INVENTOR(S) : Gustav Franzen

It is certified that error appears in the above-identified patent and that said Letters Patent are hereby corrected as shown below:

Column 1, Line 23, after "such", delete "for"; Column 1, Line 65, delete "as", insert --a--; Column 6, Line 9, after "for", delete "the"; Column 6, Line 28, delete "81'", insert --81"--;

Column 7, Line 21, delete "mechanisms", insert --mechanism--; Column 7, Line 34, delete "mechanism" insert --mechanisms--; Column 8, Line 43, delete "comletely", insert --completely--; Column 9, Line 53, before "injection", delete "an", insert --air--; Column 12, Line 44, delete "springle", insert --spindle--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*